US006404275B1

(12) United States Patent
Voldman et al.

(10) Patent No.: US 6,404,275 B1
(45) Date of Patent: Jun. 11, 2002

(54) MODIFIED CURRENT MIRROR CIRCUIT FOR BICMOS APPLICATION

(75) Inventors: Steven H. Voldman, South Burlington, VT (US); Stephen J. Ames, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/683,193

(22) Filed: Nov. 29, 2001

(51) Int. Cl.[7] ..... G05F 1/10
(52) U.S. Cl. ..... 327/538
(58) Field of Search ..... 323/315, 316, 323/317; 327/530, 534, 535, 537, 538, 540, 541, 543

(56) References Cited

U.S. PATENT DOCUMENTS 5,412,348 A * 5/1995 Kasha et al. ..... 330/288
6,107,789 A * 8/2000 Fryer et al. ..... 323/315
6,194,957 B1 * 2/2001 Fryer et al. ..... 323/316

* cited by examiner

*Primary Examiner*—Jeffrey Zweizig
(74) *Attorney, Agent, or Firm*—Whitham, Curtis & Christofferson, P.C.; Richard A. Henkler

(57) ABSTRACT

ESD (Electrostatic Discharge) robust current mirror circuits incorporate circuitry for decoupling the gate when the chip is unpowered. Additional protection is provided by a second element which provides de-biasing to prevent Vgs from being established. A third element can be added between the gate and the ground potential on the current mirror gate node to prevent the gate of the current mirror from rising too high and allows the current to be discharged through the element instead of the current mirror.

22 Claims, 7 Drawing Sheets

MODIFIED CURRENT MIRROR CIRCUIT FOR BICMOS APPLICATION

BACKGROUND OF THE INVENTION

1. Field of the Invention

The present invention generally relates to MOSFET (Metal Oxide Semiconductor Field Effect Transistor) devices, and more particularly to ESD (Electrostatic Discharge) robust current mirror devices.

2. Background Description

In BiCMOS (Bipolar/Complementary Metal Oxide Semiconductor) or radio frequency (RF) CMOS applications used for optical interconnects, current sources may appear on the output pad to drive internal current loads. For example, in one application output pins exist where a small MOSFET (Metal Oxide Semiconductor Field Effect Transistor) device drain is connected to a pad, the MOSFET device source is connected to ground and its gate is connected to another pad. The gate connection is also connected to a set of other MOSFET devices whose gates are connected to the output MOSFET device. An internal current mirror circuit is set so that the internal mirror elements are also set so the gate node of the current mirror is connected to one of the MOSFET device's drain as well.

The uniqueness of the current mirror device on an output node is that it is difficult to protect for ESD (Electrostatic Discharge) or overvoltage. As the gate node rises, the gates of the MOSFET devices are driven high, turning the MOSFET devices on. The direct coupling of the MOSFET device gates used for the current mirror acts as a MOSFET trigger. In this case, with the current mirror connection between drain and gate of the MOSFET device, the MOSFET device turns on at a much earlier voltage than the MOSFET avalanche voltage value. This circuit is then difficult to ESD protect and does not allow protection networks adequately provide protection to the MOSFET device. In the case that the MOSFET device is large (e.g., W â‰¥1000 Î¼ m, where W is the gate width), turning on the MOSFET device would be an advantage. But in the case of small elements (e.g., W>100 Î¼ m), this is a disadvantage causing difficulty to protect this circuit.

BRIEF SUMMARY OF THE INVENTION

Summary of the Invention

It is therefore an object of the present invention to provide new ESD robust current mirror circuits.

According to the invention, as a first embodiment of the invention, the current mirror circuit has a means of decoupling the gate when the chip is unpowered. This is achievable by a circuit or element which, when the circuit is in an unpowered state, decouples the gate node from the drain of the MOSFET device. As the chip is powered, this circuit or element is "on" providing the gate coupling between the drain and the gate node. This "current mirror gate disable network" can be as simple as a MOSFET device whose source and drain are in series with the gate-to-drain connection of the current mirror device, a zero voltage threshold element, power-on reset function with some logic gates. Note that this "switch" may have to be mirrored into the other end of the current mirror to establish the symmetry between the outboard and inboard current mirror sides. Another embodiment can be an element that is switched off with a parallel element (a set of diodes) to allow current flow in the current mirror element after some set voltage level to provide gate coupling after some set voltage levels.

A second embodiment of the invention provides protection by adding a second element which provides de-biasing preventing a Vgs (gate-to-source voltage) from being established. This can be done by having a second element in series which allows the source of the MOSFET device to rise preventing establishment of the Vgs potential that exceeds the Vt (threshold voltage) of the device. The current flow through the second series element from the over voltage ESD pulse provides the rise of the source. An auxiliary element sources current to the de-biasing element. For example, the gate current can flow to the element below the MOSFET device current mirror element. If for example it is a resistor, the current will bypass the MOSFET device and flow to the resistor, allowing the source to rise. This de-biases the current mirror. This can also be done by a diode element connected to VDD (source voltage) or a rail which is attached to the gate of a second element (such as a PFET or p-type FET) which turns off, forcing the source to de-couple from ground potential, allowing de-biasing of the network. Hence, the current mirror de-biasing element can cause the current mirror MOSFET device to turn off during over voltage.

In a third embodiment of the invention, an element is used between the gate and the ground potential on the current mirror MOSFET gate node to allow current to flow to ground. This element prevents the gate node from the current mirror to rise too high and allows the current to be discharged through the element instead of the current mirror MOSFET device. This can be established by a second MOSFET device that is large and that is "off" during function mode and "on" during ESD. This can be established by a diode string between the current mirror node to the ground potential.

BRIEF DESCRIPTION OF THE SEVERAL VIEWS OF THE DRAWINGS

The foregoing and other objects, aspects and advantages will be better understood from the following detailed description of a preferred embodiment of the invention with reference to the drawings, in which.

DETAILED DESCRIPTION OF THE INVENTION

DETAILED DESCRIPTION OF PREFERRED EMBODIMENTS OF THE INVENTION

Figure 1:
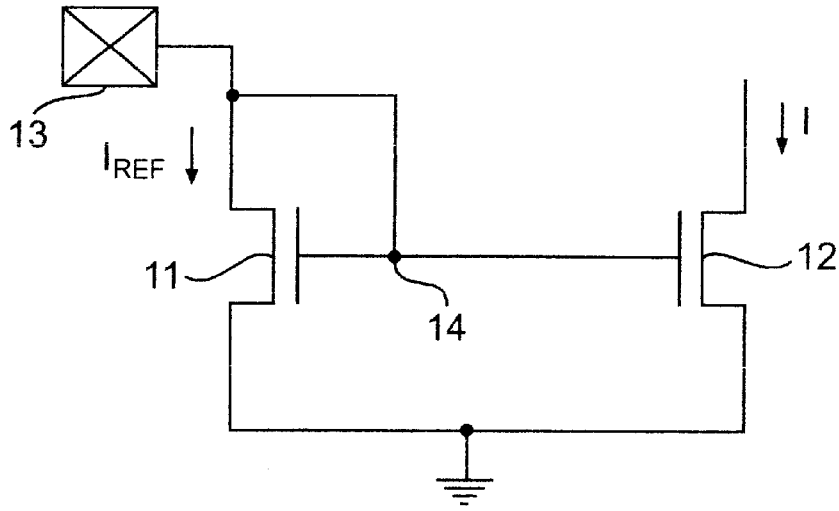
FIG. 1 PRIOR ART
FIG. 1 is a schematic diagram showing a conventional MOSFET current source.

Referring now to the drawings, and more particularly to FIG. 1, there is shown a conventional MOSFET current source comprising a pair of field effect transistors (FETs) 11 and 12. FET 11 has its source connected to a pad 13, which is the source of reference current $I_{Ref}$, and its drain connected to circuit ground. The gates of the FETs 11 and 12 are connected in common at node 14 and, in addition, to the source of FET 11. The drain of FET 12 is connected to circuit ground while its source is connected to an output pad. The current flowing in the source-drain circuit of FET 11 is the reference current $I_{Ref}$, and this current is mirrored in the current I flowing in the source-drain circuit FET 12.

Figure 2:
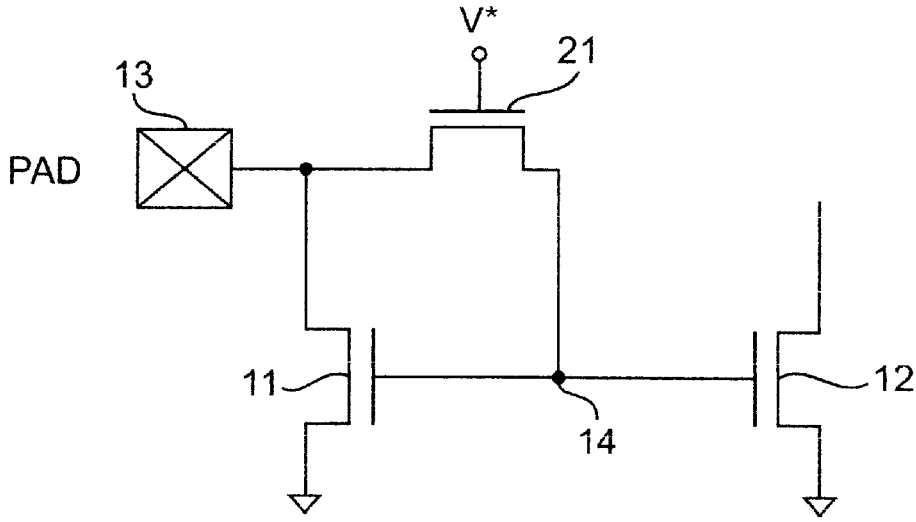
FIG. 2 is a schematic diagram showing a MOSFET current source with gate mirror ESD interrupt according to the first embodiment of the invention.

In the first embodiment of the invention, the conventional current mirror circuit shown in FIG. 1 is modified as shown in FIG. 2 to provide a means of decoupling the common or gate node 14 when the chip is unpowered. In this case, an FET 21 is substituted for the direct connection between common node 14, to which the gates of the FETs 11 and 12 are connected and the source of the FET 11. The source of the FET 21 is connected in common with the source of FET 11 to the pad 13, while the drain of FET 21 is connected to common node 14. The gate of FET 21 is connected to a voltage V*.

The voltage V* is a reference voltage, a power rail voltage or connected to additional logic. When the chip is unpowered, V* is at a low potential. As voltage is applied to pad 13, the FET 21 remains off. The FET 11 will not be turned on until the voltage applied to pad 13 exceeds the avalanche breakdown voltage of FET 21.

Figure 3:
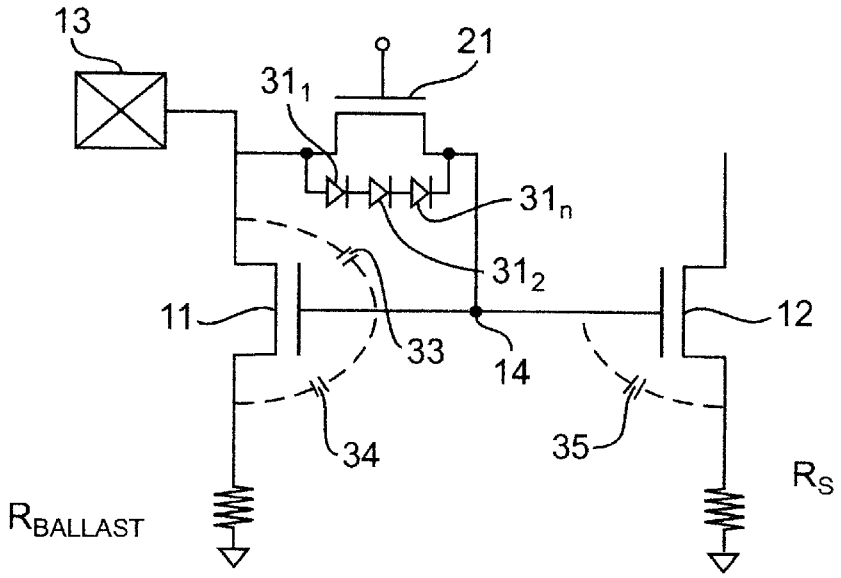
FIG. 3 is a schematic diagram showing the MOSFET current source of FIG. 2 with the addition of diode overvoltage protection and resistor ballasting according the second embodiment of the invention.

In the second embodiment of the invention, the circuit of FIG. 2 is further modified in the circuit shown in FIG. 3 by the addition of a series of diodes $\mathbf{31}_1$, $\mathbf{31}_2$, . . . , $\mathbf{31}_n$ connected in parallel with the source-drain circuit of FET 21, a ballast resistor $R_{Ballast}$ in the drain circuit of FET 11, and a resistor $R_s$ in the drain circuit of FET 12. The diodes $\mathbf{31}_1$ to $\mathbf{31}_n$ provide over voltage protection for FET 21 as well as a turn on state voltage V'. This diagram also shows the parasitic capacitances 33 between the source and gate of FET 11, 34 between the gate and drain of FET 11, and 35 between the gate and drain of FET 12. The turn-on voltage of the series of the diodes $\mathbf{31}_1$, $\mathbf{31}_2$, . . . , $\mathbf{31}_n$ is $$V_{ONIDiodes} = nV_f - \frac{n(n-1)}{2}\frac{KT}{Q}\ln(\beta+1) \qquad [t1]$$

where n is the number of diodes, $V_f$=0.7V and $\hat{I}^2$ is the parasitic bipolar gain of the PNP structure of the diode element. When $V_{av}$ of the FET 21 is greater than $V_{diode}$, current will flow to the node 14, allowing the gate of the FET 11 to rise, turning on the FET. Hence, the string of the series of diode serves as over voltage protection of element 21 as well as establishes an enabling of the gate of the FET 11 prior to avalanche breakdown of FET 11. Adding a ballast resistor in the drain circuit of FET 11 provides current uniformity.

Figure 4:
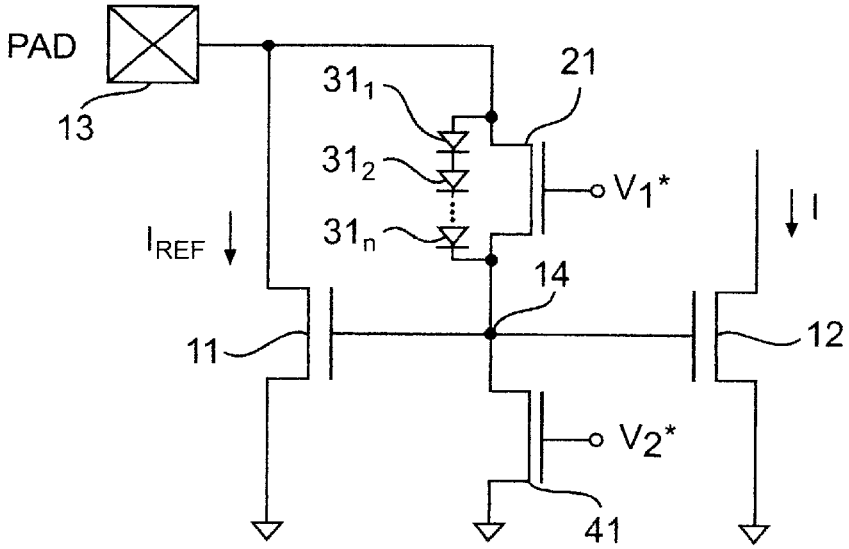
FIG. 4 is a schematic diagram showing a MOSFET current mirror with gate control interrupt, gate ground control, and overvoltage MOSFET initiator according to the third embodiment of the invention.

A further modification of the circuit according to the third embodiment of the invention is shown in FIG. 4. In this case, an additional FET 41 is added between the node 14 and circuit ground, with the source of FET 41 being connected to node 14 and the drain connected to circuit ground. The gate of FET 21 is connected to voltage $V^*_1$, and the gate of FET 41 is connected to voltage $V^*_2$. Voltage $V^*_1$ is operational in ESD mode to turn FET 21 off. Normally, FET 21 is on or conducting. Voltage $V^*_2$ is operational in ESD mode to turn FET 41 on to hold down the gate electrodes of FETs 11 and 12. Normally, FET 41 is off or non-conducting. There are N diodes $\mathbf{31}_1$ to $\mathbf{31}_n$ to allow over driving of $V^*_2$ allowing the gates of FETs 11 and 12 to rise after a set voltage level.

Figure 5:
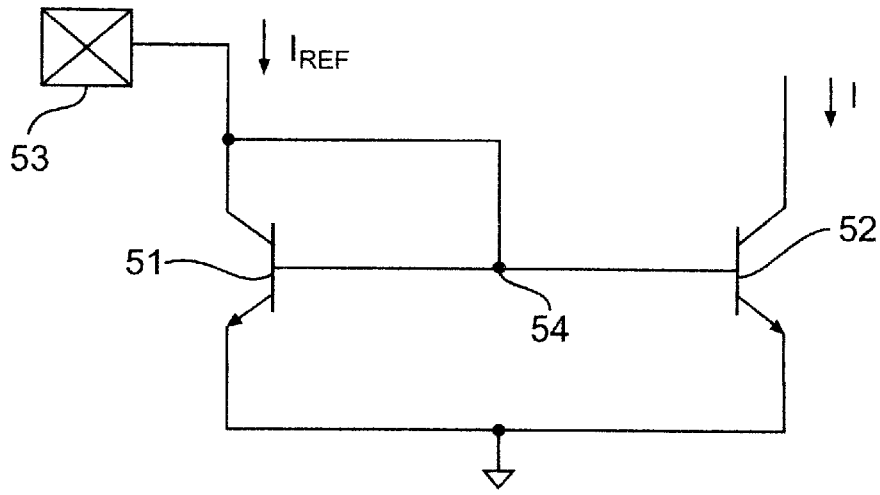
FIG. 5 PRIOR ART
FIG. 5 is a schematic diagram showing a conventional bipolar current source.

A conventional bipolar circuit is shown in FIG. 5. This circuit comprises two NPN transistors 51 and 52. The collector of transistor 51 is connected to a pad 53, which is the source of a reference current $I_{Ref}$, and the emitter of transistor 51 is connected to circuit ground. The emitter of transistor 52 is also connected to circuit ground, and the bases of transistors 51 and 52 are connected in common to node 54, which is also connected to the collector of transistor 51. The current $I_{Ref}$ flowing in the emitter-collector circuit of transistor 51 is mirrored in the current I flowing in the emitter-collector circuit of transistor 52.

Figure 6:
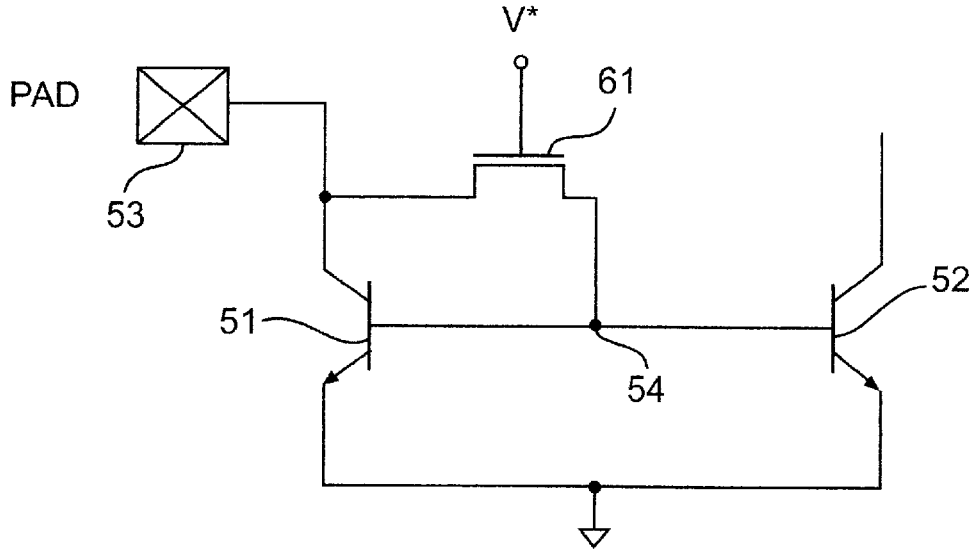
FIG. 6 is a schematic diagram showing a bipolar current source with an ESD control device according to the first embodiment of the invention.

Similar to the circuit of FIG. 2, the circuit of FIG. 5 is modified as shown in FIG. 6 by the addition of an FET 61 connected between the node 54 and the collector of transistor 51. The source of FET 61 is connected to the collector of transistor 51, the drain of FET61 is connected to node 54, and the gate of FET 61 is connected to a voltage V* which can be a power rail, a reference voltage or control logic.

Note that the current mirror disabling network can be a bipolar transistor of which the base is connected to V*. In this circuit, with the current mirror disabling network element 61, the bases of the NPN transistors 51 and 52 are effectively disconnected from pad 53. Without element 61, the turn-on would be a single $V_{be}$ (â‰ˆ0.7V) from the pad 53. With the disabling of the base-coupling, the bipolar element 51 discharges current at the open-base breakdown voltage $BV_{CEO}$.

Figure 7:
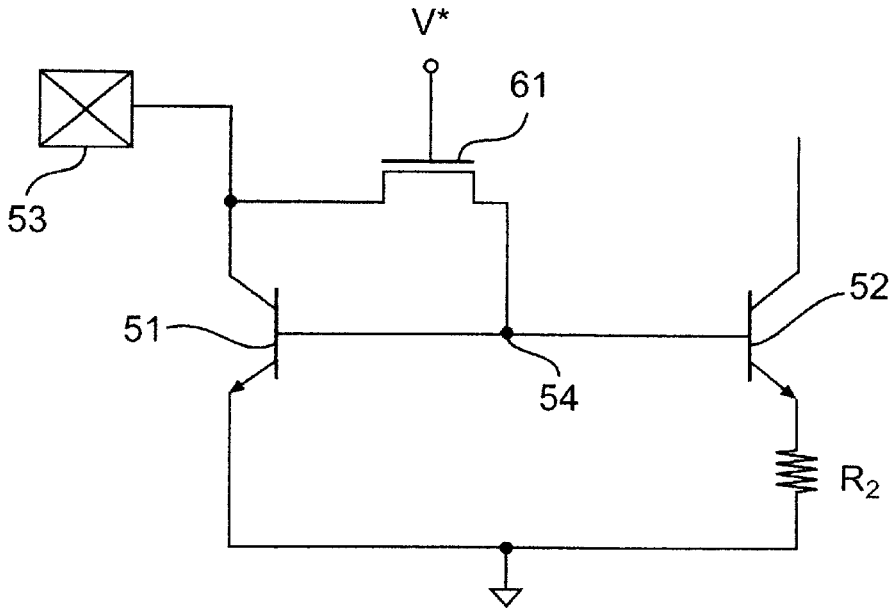
FIG. 7 is a schematic diagram showing the bipolar current source of FIG. 6 with th addition of a resistor in the emitter circuit of the output NPN transistor according to the second embodiment of the invention.

The circuit of FIG. 6 is modified as shown in FIG. 7 by the addition of a resistor R2 in the emitter circuit of transistor 52 in accordance with the second embodiment of the invention.

Figure 8:
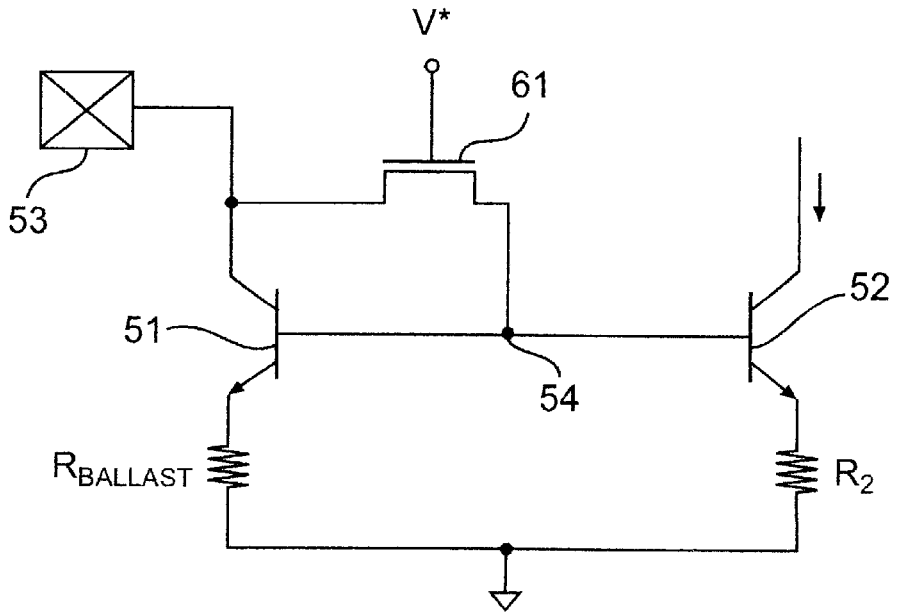
FIG. 8 is a schematic diagram showing the bipolar current source of FIG. 6 with the addition of emitter resistor ballasting according to the second embodiment of the invention.

As shown in FIG. 8 a ballast resistor $R_{Ballast}$ can be connected in the emitter circuit of transistor 51. By adding resistor R2, both the emitter thermal stability and prevention of current flow through transistor 52 are established. In FIG. 8, ballast resistor $R_{Ballast}$ and resistor R2 establish thermal stability, emitter feedback de-biasing and a new current source relationship.

Figure 9:
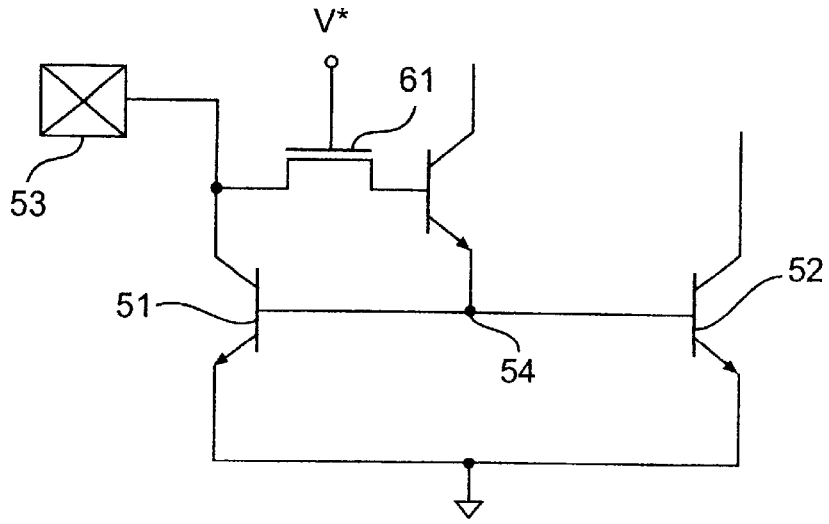
FIG. 9 is a schematic diagram showing a bipolar current source with current gain and ESD control circuit according to the first embodiment of the invention.

The basic circuit of FIG. 6 can be further modified as shown in FIG. 9 by the addition of NPN transistor 91. The drain of FE 61 is connected to the base of transistor 91, and the emitter of transistor 91 is connected to node 54. The transistor 91 provides current gain 12 to the current source. In the high current gain current source, without the FET 61, the current source would be on at $2V_{be}$. By adding the FET 61, the node 54 is decoupled from the pad 53 delaying the current source from turning-on until the $BV_{CEO}$ of transistor 51.

Figure 10:
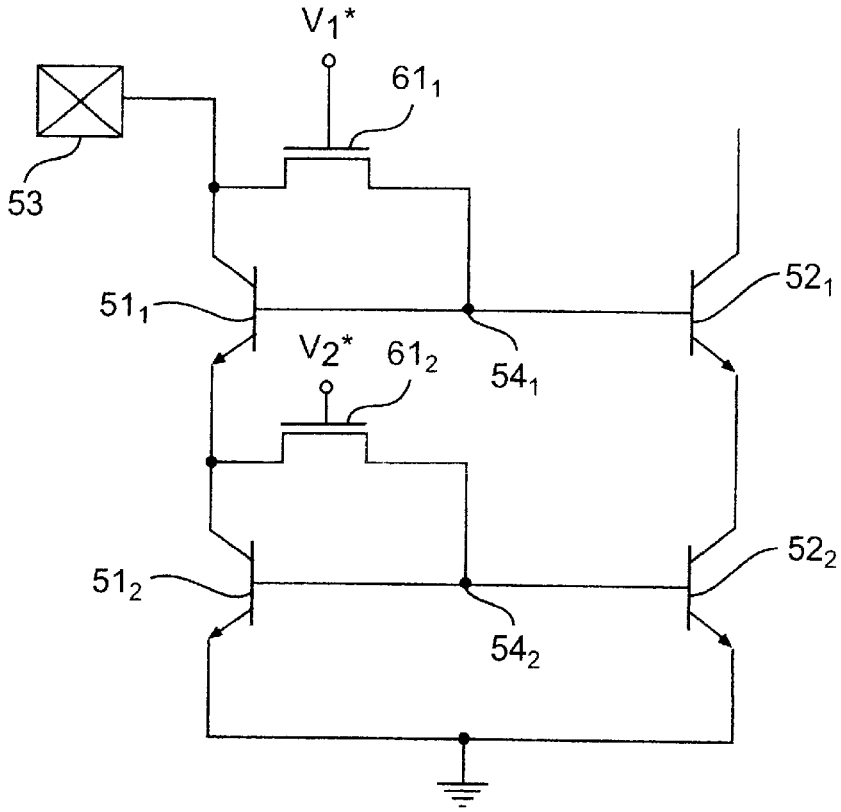
FIG. 10 is a schematic diagram showing a cascaded bipolar current source with ESD NPN diode-connect interrupt control switch according to the first embodiment of the invention.

Another variation of the circuit shown in FIG. 6 is shown in FIG. 10 where two circuits are connected in cascode. More specifically, NPN transistors $\mathbf{51}_1$ and $\mathbf{51}_2$ are connected in series between pad 53 and circuit ground, and NPN transistors $\mathbf{52}_1$ and $\mathbf{52}_2$ are connected in series. ESD protection FETs $\mathbf{61}_1$ and $\mathbf{61}_2$ are connected between the sources of transistors $\mathbf{51}_1$ and $\mathbf{51}_2$, respectively, and nodes $\mathbf{54}_1$ and $\mathbf{54}_2$, respectively. Voltages $V^*_1$ and $V^*_2$ are connected to the gates of FETs $\mathbf{61}_1$ and $\mathbf{61}_2$, respectively.

Figure 11:
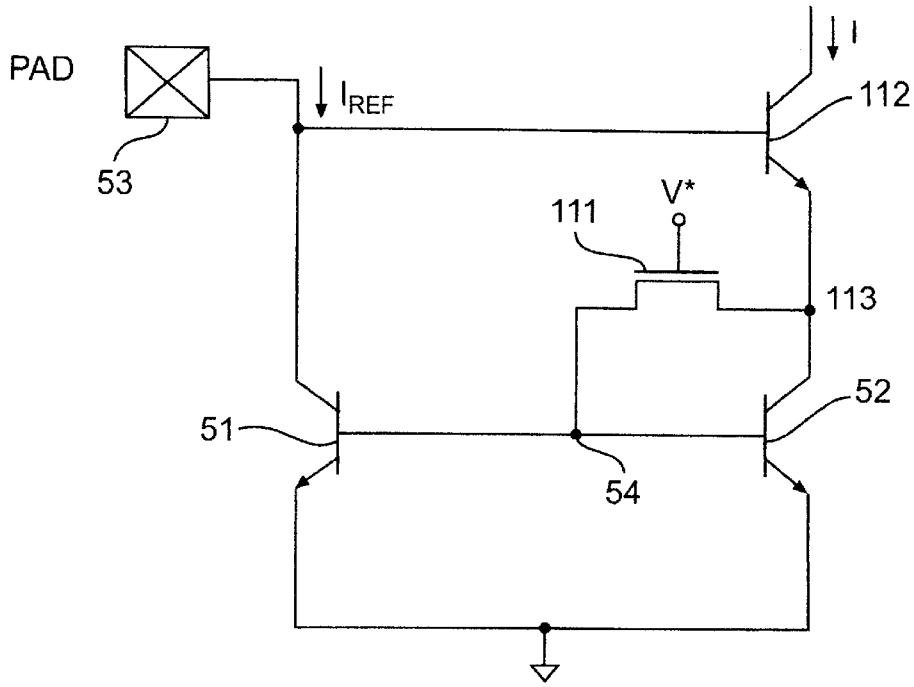
FIG. 11 is a schematic diagram showing a bipolar current source with feedback diode connect interrupt ESD control switch according to the first embodiment of the invention.

Instead of having the ESD protection FET connected as shown in FIG. 6, an ESD protection FET 111 can be connected as a feedback element between the collector of NPN transistor 52 and node 54, as shown in FIG. 11. In this case, a further NPN transistor 112 is connected in series with transistor 52, with the emitter of transistor 112 being connected to a node 113 to which is connected the source of FET 111 and the collector of transistor 52. The base of transistor 112 is connected to the pad 53 in common with the collector of transistor 51.

Figure 12:
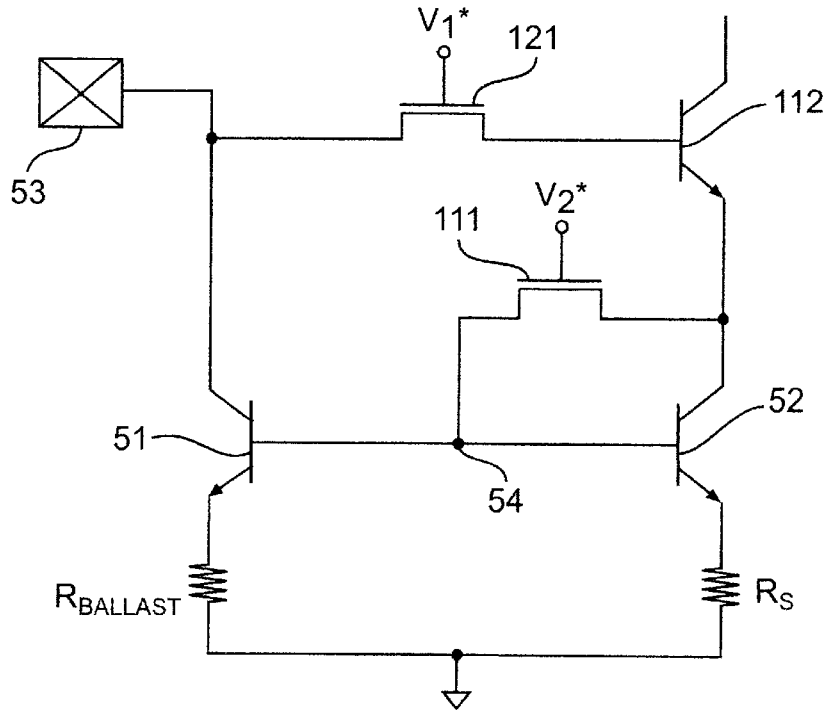
FIG. 12 is a schematic diagram showing a bipolar current source with base-control interrupt and diode-connected interrupt and resistor ballast according to the first and second embodiments of the invention.

The circuit of FIG. 11 can be further modified as shown in FIG. 12 where an FET 121 is connected between the pad 53 and the base of transistor 112. Voltages $V^*_1$ and $V^*_2$ are respectively connected to the gates of FETs 111, and 121. A ballast resistor $R_{Ballast}$ is connected in the emitter circuit of transistor 51, and resistor $R_s$ is connected in the emitter circuit of transistor 52.

Figure 13:
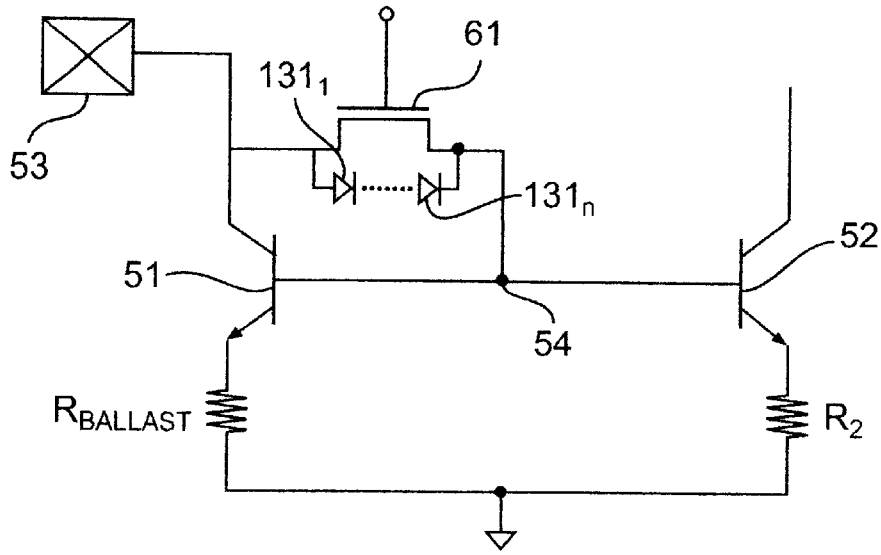
FIG. 13 is a schematic diagram showing a bipolar current source with diode connection interrupt and overvoltage base initiator according to the first and second embodiments of the invention.
Figure 14:
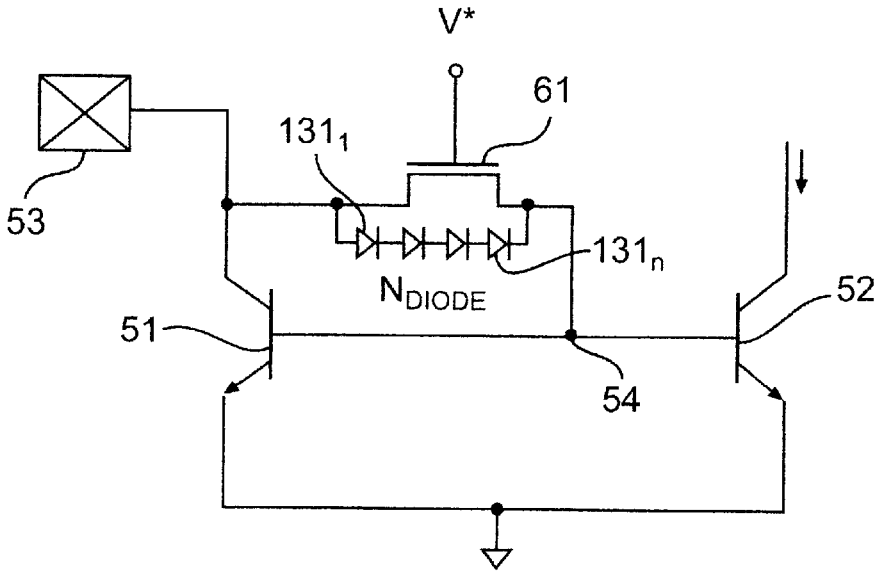
FIG. 14 is a schematic diagram showing a bipolar current source with current source interrupt and overvoltage base initiator according to the first embodiment of the invention.

The circuit of FIG. 8 is modified in the circuit shown in FIG. 13 by the addition of diodes $\mathbf{131}_1$ to $\mathbf{131}_n$ in parallel with the source-drain circuit of FET 61. In the variation of the circuit of FIG. 13, the ballast resistor in the emitter circuit of transistor 51 and the resistor in the emitter of transistor 52 are omitted. To provide a turn-on of the base connection as well as to provide over voltage protection of the element 61, a series of diodes can be added to the previously mentioned circuits. FIG. 14 shows an example applied to the current source network. When the diode series voltage is on, this will turn on transistors 51 and 52, providing turn-on of these transistors prior to avalance breakdown or $BV_{CEO}$.

While the invention has been described in terms of preferred embodiments, those skilled in the art will recognize that the invention can be practiced with modification within the spirit and scope of the appended claims.

What is claimed is:

1. An electrostatic discharge (ESD) robust current mirror circuit comprising a current mirror coupled to an output pad, said current mirror having a common node connected to the output pad and incorporating means for decoupling the common node from the output pad when the current mirror circuit is unpowered to protect the current mirror from ESD events.

2. The electrostatic discharge (ESD) robust current mirror circuit of claim 1, where said current mirror comprises:

a first transistor coupled between a first current source and a second current source; and a second transistor coupled between said output pad and said second current source;

said common node interconnecting control electrodes of said first and second transistors.

3. The electrostatic discharge (ESD) robust current mirror circuit of claim 2, wherein said means for decoupling the common node from the output pad comprises a third transistor coupled between said common node and said output pad and having a control electrode connected to a first reference voltage source.

4. The electrostatic discharge (ESD) robust current mirror circuit of claim 3, wherein said first and second transistors are field effect transistors.

5. The electrostatic discharge (ESD) robust current mirror circuit of claim 3, wherein said first and second transistors are bipolar transistors.

6. The electrostatic discharge (ESD) robust current mirror circuit of claim 3, wherein said third transistor is a field effect transistor.

7. The electrostatic discharge (ESD) robust current mirror circuit of claim 3, wherein said third transistor is a bipolar transistor.

8. The electrostatic discharge (ESD) robust current mirror circuit of claim 3, further comprising a first resistor coupled between said first transistor and said second current source.

9. The electrostatic discharge (ESD) robust current mirror circuit of claim 8, further comprising a second resistor coupled between said second transistor and said second current source.

10. The electrostatic discharge (ESD) robust current mirror circuit of claim 3, further comprising a series of diodes coupled in parallel with said third transistor between common node and said output pad.

11. The electrostatic discharge (ESD) robust current mirror circuit of claim 10, further comprising a first resistor coupled between said first transistor and said second current source.

12. The electrostatic discharge (ESD) robust current mirror circuit of claim 11, further comprising a second resistor coupled between said second transistor and said second current source.

13. The electrostatic discharge (ESD) robust current mirror circuit of claim 10, further comprising a fourth transistor coupled between said common node and said second current source and having a control electrode connected to a second reference voltage source.

14. The electrostatic discharge (ESD) robust current mirror circuit of claim 2, wherein said means for decoupling the common node from the output pad comprises:

a third transistor coupled between a third current source and said common node; and a fourth transistor coupled between said output pad and a control electrode of said third transistor and having a control gate connected to a first reference voltage source.

15. The electrostatic discharge (ESD) robust current mirror circuit of claim 2, further comprising:

a third transistor coupled between said first transistor and said second current source;

a fourth transistor coupled between said third transistor and said second current source; and a second node interconnecting control electrodes of said third and fourth transistors.

16. The electrostatic discharge (ESD) robust current mirror circuit of claim 15, wherein said means for decoupling the common node from the output pad comprises:

a fifth transistor coupled between said output pad and said common node and having a control electrode connected to a first reference current source; and a sixth transistor coupled between said second node and a node between said second and fourth transistors and having a control electrode connected to a second reference current source.

17. The electrostatic discharge (ESD) robust current mirror circuit of claim 2, wherein said means for decoupling the common node from the output pad comprises:

a third transistor coupled between said first current source and said first transistor and having a control electrode connected to said output node; and a fourth transistor coupled between said common node and a node between said first and third transistors and having a control electrode connected to a first reference voltage source.

18. The electrostatic discharge (ESD) robust current mirror circuit of claim 17, wherein said means for decoupling the common node from the output pad further comprises a fifth transistor coupled between said output pad and said control electrode of said third transistor and having a control electrode connected to a second reference voltage source.

19. The electrostatic discharge (ESD) robust current mirror circuit of claim 18, wherein said means for decoupling the common node from the output pad further comprises:

a first resistance element coupled between said first transistor and said second current source; and a second resistance element coupled between said second transistor and said second current source.

20. An electrostatic discharge (ESD) robust current mirror circuit comprising:

an output pad;

a first transistor coupled between a first current source and a second current source and having a control electrode;

a second transistor coupled between said output pad and said second current source and having a control electrode;

a first node coupled between said control electrodes of said first and second transistors; and a third transistor coupled between said output pad and said first node and having a control electrode coupled to a first reference voltage source.

21. The electrostatic discharge (ESD) robust current mirror circuit of claim 20, further comprising a series of diodes coupled in parallel with said third transistor between said output pad and said fist node.

22. The electrostatic discharge (ESD) robust current mirror circuit of claim 21, further comprising:

a first resistor coupled between said first transistor and said second current source; and a second resistor coupled between said second transistor and said second current source.

* * * * *